US011549166B2

(12) United States Patent
Pinger et al.

(10) Patent No.: US 11,549,166 B2
(45) Date of Patent: Jan. 10, 2023

(54) HOT-DIP GALVANIZATION SYSTEM AND HOT-DIP GALVANIZATION METHOD

(71) Applicant: Fontaine Holdings NV, Houthalen (BE)

(72) Inventors: Thomas Pinger, Haltern am See (DE); Lars Baumgürtel, Nottuln (DE)

(73) Assignee: FONTAINE HOLDINGS NV

( * ) Notice: Subject to any disclaimer, the term of this patent is extended or adjusted under 35 U.S.C. 154(b) by 299 days.

(21) Appl. No.: 16/083,632

(22) PCT Filed: Jan. 9, 2017

(86) PCT No.: PCT/EP2017/050307
§ 371 (c)(1),
(2) Date: Sep. 10, 2018

(87) PCT Pub. No.: WO2017/153062
PCT Pub. Date: Sep. 14, 2017

(65) Prior Publication Data

US 2019/0048452 A1 Feb. 14, 2019

(30) Foreign Application Priority Data

Mar. 9, 2016 (DE) ..... 10 2016 002 782.7
Mar. 16, 2016 (DE) ..... 10 2016 104 854.2
Apr. 12, 2016 (DE) ..... 10 2016 106 660.5

(51) Int. Cl.

| | |
|---|---|
| ***C23C 2/06*** | (2006.01) |
| ***C23C 2/30*** | (2006.01) |
| ***C23C 2/00*** | (2006.01) |
| ***C23C 2/14*** | (2006.01) |
| ***C23C 2/26*** | (2006.01) |
| ***C23C 2/02*** | (2006.01) |
| *C23C 2/38* | (2006.01) |

(52) U.S. Cl.
CPC ..... *C23C 2/003* (2013.01); *C23C 2/02* (2013.01); *C23C 2/06* (2013.01); *C23C 2/14* (2013.01); *C23C 2/26* (2013.01); *C23C 2/30* (2013.01); *C23C 2/385* (2013.01)

(58) Field of Classification Search
None
See application file for complete search history.

(56) References Cited

U.S. PATENT DOCUMENTS 1,935,087 A * 11/1933 Free ..... C23C 2/385 118/423
3,639,142 A * 2/1972 Maxwell ..... C23C 2/385 118/503
3,701,336 A * 10/1972 McConnell ..... C23C 2/385 118/423
3,978,816 A * 9/1976 Saloom ..... C23C 2/385 118/426

(Continued)

FOREIGN PATENT DOCUMENTS

WO 9504607 2/1995

*Primary Examiner* — Binu Thomas
(74) *Attorney, Agent, or Firm* — Edward E. Sowers; Brannon Sowers & Cracraft PC

(57) ABSTRACT

The invention relates to a system and a method for the hot-dip galvanization of components, preferably for mass-production hot-dip galvanization of a plurality of identical or similar components, in particular in batches, preferably for batch galvanization.

12 Claims, 4 Drawing Sheets

(56) References Cited

U.S. PATENT DOCUMENTS

| | | | | |
|---|---|---|---|---|
| 6,277,443 | B1 | 8/2001 | Stefanick | |
| 2003/0219543 | A1 | 11/2003 | Warichet et al. | |
| 2011/0195191 | A1* | 8/2011 | Bottanelli | C23C 2/02<br>427/310 |

* cited by examiner

HOT-DIP GALVANIZATION SYSTEM AND HOT-DIP GALVANIZATION METHOD

CROSS-REFERENCES TO RELATED APPLICATIONS

This application is a National Stage filing of International Application PCT/EP 2017/050307, filed Jan. 9, 2017, entitled HOT-DIP GALVANIZATION SYSTEM AND HOT-DIP GALVANIZATION METHOD, claiming priority to German Application Nos. DE 10 2016 002 782.7 filed Mar. 9, 2016, DE 10 2016 104 854.2 filed Mar. 16, 2016, and DE 10 2016 106 660.5 filed Apr. 12, 2016. The subject application claims priority to PCT/EP 2017/050307, to DE 10 2016 002 782.7, to DE 10 2016 104 854.2, and to DE 10 2016 106 660.5 and incorporates all by reference herein, in their entirety.

BACKGROUND OF THE INVENTION

The present invention relates to the technical field of the galvanization of iron-based and/or iron-containing components, in particular steel-based and/or steel-containing components (steel components), preferably for the automobile and/or automotive industry, by means of hot dip galvanization.

In particular, the present invention relates to a system and also a method for hot dip galvanizing of components (i.e., of iron-based and/or iron-containing components, steel-based and/or steel-containing components (steel components)), in particular for the large-scale (high-volume) hot dip galvanizing of a multiplicity of identical or similar components (e.g., automotive components), in discontinuous operation (referred to as batch galvanizing).

Metallic components of any kind consisting of iron-containing material, and in particular components made of steel, often require application-related an efficient protection against corrosion. In particular, components consiting of steel for motor vehicles (automotive), such as for example automobiles, trucks, utility vehicles and so on, require efficient protection against corrosion that withstands even long-term exposures.

In this connection it is known practice to protect steel-based components against corrosion by means of galvanizing (zinc coating). In galvanizing, the steel is provided with a generally thin zinc coat in order to protect the steel against corrosion. There are various galvanizing methods that can be used to galvanize components consisting of steel, in other words to coat them with a metallic covering of zinc, including in particular the methods of hot dip galvanizing, zinc spraying (flame spraying with zinc wire), diffusion galvanizing (Sherardizing), electrogalvanizing (electrolytic galvanizing), nonelectrolytic galvanization by means of zinc flake coatings, and also mechanical zinc coating. There are great differences between the aforesaid galvanizing methods, in particular with regard to their implementation, but also to the nature and properties of the zinc layers and/or zinc coatings produced.

Probably the most important method for corrosion protection of steel by means of metallic zinc coatings is that of hot dip galvanizing. Thereby steel is immersed continuously (e.g. coil and wire) or piecemeal (e.g. components) in a heated tank comprising liquid zinc at temperatures from around 450° C. to 600° C. (melting point of zinc: 419.5° C.), thus forming on the steel surface a resistant alloy layer of iron and zinc and, over that, a very firmly adhering pure zinc layer.

In the context of hot dip galvanizing, a distinction is made between discontinuous batch galvanizing (cf., e.g. DIN EN ISO 1461) and continuous strip galvanizing (DIN EN 10143 and DIN EN 10346). Both batch galvanizing and strip galvanizing are normalized and/or standardized processes. Strip-galvanized steel is a precursor and/or intermediate (semifinished product) which, after having been galvanized, is processed further by means in particular of forming, punching, trimming, etc., whereas components to be protected by batch galvanizing are first fully manufactured and only therafter subjected to hot dip galvanizing (thus providing the components with all-round corrosion protection). Batch galvanizing and strip galvanizing also differ in terms of the thickness of the zinc layer, resulting in different durations of protection. The zinc layer thickness on strip-galvanized sheets is usually not more than 20 to 25 micrometers, whereas the zinc layer thicknesses of batch-galvanized steel parts are customarily in the range from 50 to 200 micrometers and even more.

Hot dip galvanizing affords both active and passive corrosion protection. The passive protection is through the barrier effect of the zinc coating. The active corrosion protection occurs due to the cathodic activity of the zinc coating. Relative to more noble metal of the electrochemical series, such as for example iron, zinc serves as a sacrificial anode, protecting the underlying iron from corrosion until the zinc itself is corroded entirely.

The so-called batch galvanizing according to DIN EN ISO 1461 is used for the hot dip galvanizing of usually relatively large steel components and constructions. Thereby steel-based blanks or completed workpieces (components) being pretreated and then immersed into the zinc melt bath. The immersion allows, in particular, even internal faces, welds, and difficult-to-access locations on the components or workpieces for galvanizing to be easily reached.

Conventional hot dip galvanizing is based in particular on the dipping of iron and/or steel components into a zinc melt to form a zinc coating or zinc covering on the surface of the components. In order to ensure the adhesiveness, the imperviosity, and the unitary nature of the zinc coating, there is generally a requirement beforehand for thorough surface preparation of the components to be galvanized, customarily comprising a degrease with subsequent rinsing operation, a subsequent acidic pickling with downstream rinsing process, and, finally, a flux treatment (i.e. so-called fluxing), with a subsequent drying operation.

The typical process sequence of conventional batch galvanizing by hot dip galvanization customarily takes the following form: in the case of batch galvanizing of identical or similar components (e.g. series production of automotive components), for reasons of process economy and economics, they are typically collated and/or grouped for the entire procedure (this being done in particular by means of a common goods carrier, configured for example as a cross-beam or rack, or of a common mounting and/or attachment device for a multiplicity of these identical and/or similar components). For this purpose, a plurality of components is attached on the goods carrier via holding means, such as for example slings, tie wires or the like. The components in the grouped state are subsequently supplied via the article carrier to the subsequent treatment steps and/or stages.

First of all, the component surfaces of the grouped components are subjected to degreasing, in order to remove residues of greases and oils, wherein degreasing agents in the form, customarily, of aqueous alkaline or acidic degreasing agents are employed. Cleaning in the degreasing bath is followed customarily by a rinsing operation, typically by immersion into a water bath, in order to prevent degreasing agents being entrained with the galvanization material into the next operational step of pickling, this being especially important in the case of the switch from alkaline degreasing to an acidic base.

The next step is that of pickle treatment (pickling), which serves in particular to remove homologous impurities, such as for example rust and scale from the steel surface. Pickling is customarily accomplished in dilute hydrochloric acid, with the duration of the pickling procedure being dependent on factors including the contamination status (e.g. degree of rusting) of the galvanization material, and on the acid concentration and temperature of the pickling bath. In order to prevent and/or minimize entrainments of residual acid and/or residual salt with the galvanization material, the pickling treatment is customarily followed by a rinsing operation (rinse step).

This is followed by what is called fluxing (treatment with flux), in which the previously degreased and pickled steel surface with what is called a flux, typically comprising an aqueous solution of inorganic chlorides, most frequently with a mixture of zinc chloride ($ZnCl_2$) and ammonium chloride ($NH_4Cl$). On the one hand, the task of the flux is to carry out a final intensive fine-purification of the steel surface prior to the reaction of the steel surface with the molten zinc, and to dissolve the oxide skin on the zinc surface, and also to prevent renewed oxidation of the steel surface prior to the galvanizing procedure. On the other hand, the flux raises the wetting capacity between the steel surface and the molten zinc. The flux treatment is customarily followed by a drying operation in order to generate a solid film of flux on the steel surface and to remove adhering water, thus avoiding subsequently unwanted reactions (especially the formation of steam) in the liquid zinc dipping bath.

The components pretreated in the manner indicated above are then subjected to hot dip galvanizing by being immersed into the liquid zinc melt. In the case of hot dip galvanizing with pure zinc, the zinc content of the melt according to DIN EN ISO 1461 is at least 98.0 wt %. After the galvanization material has been immersed into the molten zinc, it remains in the zinc melting bath for a sufficient time period, in particular until the galvanization material has assumed its temperature and is coated with a zinc layer. The surface of the zinc melt is typically cleaned to remove, in particular, oxides, zinc ash, flux residues and the like, before the galvanization material is then extracted from the zinc melt again. The component hot dip galvanized in this way is then subjected to a cooling process (e.g. in the air or in a water bath). Lastly, the holding means for the component, such as for example slings, tie wires or the like, are removed. Subsequent to the galvanizing operation, there is customarily a reworking or aftertreatment operation, which in some cases is involved. Here excess zinc residues, particularly what are called drip edges and streaks of the zinc solidifying on the edges, and also oxide or ash residues adhering to the component, are removed as far as possible.

One criterion of the quality of hot dip galvanization is the thickness of the zinc coating in μm (micrometers). The standard DIN EN ISO 1461 specifies the minimum values of the requisite coating thicknesses to be afforded, depending on thickness of material, in batch galvanizing. In actual practice, the coat thicknesses are well above the minimum coat thicknesses specified in DIN EN ISO 1461. Generally speaking, zinc coatings produced by batch galvanizing have a thickness in the range from 50 to 200 micrometers or even more.

In the galvanizing process, as a consequence of mutual diffusion between the liquid zinc and the steel surface, a coating of iron/zinc alloy layers with differing compositions is formed on the steel part. On withdrawal of the hot dip galvanized articles, a layer of zinc—also referred to as pure zinc layer—remains adhering to the uppermost alloy layer, this layer of zinc having a composition corresponding to that of the zinc melt. On account of the high temperatures associated with the hot dipping, a relatively brittle layer is formed initially on the steel surface, this layer being based on an alloy (mixed crystals) between iron and zinc, with the pure zinc layer only being formed atop that layer. While the relatively brittle iron/zinc alloy layer does improve the strength of adhesion to the base material, it also hinders the formability of the galvanized steel. Greater amounts of silicon in the steel, of the kind used in particular for the so-called calming of the steel during its production, result in increased reactivity between the zinc melt and the base material and, consequently, in strong growth of the iron/zinc alloy layer. In this way, relatively high overall layer thicknesses are formed. While this does enable a very long period of corrosion protection, it nevertheless also raises the risk, in line with increasing thickness of the zinc layer, that the layer will flake off under mechanical exposure, particularly sudden, local exposures, thereby destroying the corrosion protection effect.

In order to counteract the above-outlined problem of the incidence of the rapidly growing, brittle and thick iron/zinc alloy layer, and also to enable relatively low layer thicknesses in conjunction with high corrosion protection in the case of galvanizing, it is known practice from the prior art additionally to add aluminum to the zinc melt or to the liquid zinc bath. For example, by adding 5 wt % of aluminum to a liquid zinc melt, a zinc/aluminum alloy is produced that has a melting temperature lower than that of pure zinc. By using a zinc/aluminum melt (Zn/Al melt) and/or a liquid zinc/aluminum bath (Zn/Al bath), on the one hand it is possible to realize much lower layer thicknesses for reliable corrosion protection (generally of below 50 micrometers); on the other hand, the brittle iron/tin alloy layer is not formed, because the aluminum—without being tied to any particular theory—initially forms, so to speak, a barrier layer on the steel surface of the component in question, with the actual zinc layer then being deposited on this barrier layer. Components hot dip galvanized with a zinc/aluminum melt are therefore readily formable, but nevertheless—in spite of the significantly lower layer thickness by comparison with conventional hot dip galvanizing with a quasi-aluminum-free zinc melt—exhibit improved corrosion protection qualities. Relative to pure zinc, a zinc/aluminum alloy used in the hot dip galvanizing bath exhibits enhanced fluidity qualities. Moreover, zinc coatings produced by hot dip galvanizing carried out using such zinc/aluminum alloys have a greater corrosion resistance (from two to six times better than that of pure zinc), enhanced shapability, and improved coatability relative to zinc coatings formed from pure zinc. This technology, moreover, can also be used to produce lead-free zinc coatings.

A hot dip galvanizing method of this kind using a zinc/aluminum melt and/or using a zinc/aluminum hot dip galvanizing bath is for example known from WO 2002/042512 A1 and the relevant equivalent publications to this patent family (e.g., EP 1 352 100 B1, DE 601 24 767 T2 and US 2003/0219543 A1). Also disclosed therein, are suitable fluxes for the hot dip galvanizing by means of zinc/aluminum melt baths, since flux compositions for zinc/aluminum hot dip galvanizing baths are different to those for conventional hot dip galvanizing with pure zinc. With the method disclosed therein it is possible to generate corrosion protection coatings having very low layer thicknesses (generally well below 50 micrometers and typically in the range from 2 to 20 micrometers) and having very low weight in conjunction with high cost-effectiveness, and accordingly the method described therein is employed commercially under the designation of microZINQ® process.

In the batch hot dip galvanizing of components in zinc/aluminum melt baths, in particular in the case of large-scale batch hot dip galvanizing of a multiplicity of identical or similar components (e.g., large-scale batch hot dip galvanizing of automotive components and/or in the automobile industry), because of the more difficult wettability of the steel with the zinc/aluminum melt and also the low thickness of the zinc coverings and/or zinc coatings, there is a problem with always subjecting the identical and/or similar components to identical operating conditions and operating sequences in an economic process sequence, in particular with implementing high-precision hot dip galvanizing reliably and reproducibly in a manner which affords identical dimensional integrities for all identical or similar components. In the prior art—as well as by costly and inconvenient pretreatment, especially with selection of specific fluxes—this is typically accomplished in particular by special process control during the galvanizing procedure, such as, for example, extended immersion times of the components into the zinc/aluminum melt, since only in this way it is ensured that there are no defects in the relatively thin zinc coatings, or no uncoated or incompletely coated regions.

In order to make the processing sequence economical for the known hot dip galvanizing of identical and/or similar components, more particularly in the case of large-scale batch hot dip galvanizing, and to ensure an identical process sequence, the prior art collates or groups a multiplicity of the identical or similar components for galvanizing, on a common goods carrier or the like, for example, and guides them in the grouped state through the individual process stages, and especially the galvanizing bath.

The known piece hot dip galvanizing, however, has various disadvantages. If the articles on the goods carrier are hung in two or more layers, and especially if the immersion movement of the goods carrier is the same as the emersion movement, the components and/or regions of components inevitably do not spend the same time in the zinc melt. This results in different reaction times between the material of the components and of the zinc melt, and, consequently, in different zinc layer thicknesses on the components. Furthermore, in the case of components with high temperature sensitivity, in particular in the case of high-strength and ultra high-strength steels, such as for example spring steels, chassis and bodywork components, and press-hardened forming parts, differences in residence times in the zinc melt affect the mechanical characteristics of the steel. With a view to ensuring defined characteristics on the part of the components, it is vital that defined operating parameters are observed for each individual component.

Furthermore, on withdrawal of the components from the zinc melt, it is inevitable that the zinc will run and will drip from edges and angles of the components. This produces zinc bumps on the component. Eliminating these zinc bumps subsequently, which is normally a manual task, represents a considerable cost factor, particularly if the piece numbers being galvanized are high and/or if the tolerance requirements to be observed are exacting. With a fully laden goods carrier, it is generally not possible to reach all of the components and there individually remove the zinc bumps directly at the site of galvanizing. Customarily, after galvanizing, the galvanized components have to be taken off from the goods carrier, and must be manually examined and worked on individually, in a very costly and inconvenient operation.

Moreover, in the case of the known batch hot dip galvanizing, the immersion and emersion movement of the goods carrier into and out of the galvanizing bath takes place at the same location. The process-related occurrence of zinc ash, as a reaction product of the flux and the zinc melt, after the immersion of the components, this ash accumulating on the surface of the zinc bath, makes it absolutely necessary, before emersion, for the zinc ash to be removed from the surface by drawing off or washing away, in order to prevent it adhering to the galvanized components on withdrawal, to create as little contamination as possible on the galvanized component. In view of the large number of components in the zinc bath and in view of the comparatively poor accessibility of the surface of the galvanizing bath, removing the zinc ash from the bath surface proves generally to be a very costly and inconvenient, and in some cases problematical, operation. On the one hand, there is a delay to the operation with a reduction in productivity at the same time within the removal of the zinc ash from the surface of the galvanizing bath and, on the other hand, there is a source of defects in relation to the quality of galvanization of the individual components.

Ultimately, with the known piece hot dip galvanizing, contaminants and zinc bumps remain on the galvanized components and must be removed by manual afterwork. This afterwork is generally very costly and time-consuming. In this regard it should be noted that afterwork here refers not only to the cleaning and/or remediation, but also, in particular, to the visible inspection. For process-related reasons, all of the components are subject to a risk of contaminants adhering or zinc bumps being present, and requiring removal. Accordingly, all of the components must be looked at individually. This inspection alone, without any subsequent steps of work that may be necessary, represents a very high cost factor, in particular in the large-scale production sector with a very large number of components to be inspected and with very high quality requirements.

BRIEF SUMMARY OF THE INVENTION

The problem addressed by the present invention is therefore that of providing a system and a method for piece galvanizing iron-based or iron-containing components, in particular steel-based or steel-containing components (steel components), by means of hot dip galvanizing in a zinc/aluminum melt (i.e. in a liquid zinc/aluminum bath), preferably for the large-scale hot dip galvanizing of a multiplicity of identical or similar components (e.g. automotive components), in which the disadvantages outlined above for the prior art are to be at least largely avoided or else at least diminished.

In particular, the intention is to provide a system and a method which, relative to conventional hot dip galvanizing systems and methods, enable improved operational economics and a more efficient, and especially more flexible, operating sequence.

In order to solve the problem outlined above the present invention—according to a first aspect of the present invention—proposes a system for hot dip galvanizing; further embodiments, especially particular and/or advantageous embodiments, of the system of the invention are also disclosed.

The present invention further relates—according to a second aspect of the present invention—to a method for hot dip galvanizing; further embodiments, especially particular and/or advantageous embodiments, of the method of the invention are also disclosed.

With regard to the observations hereinafter, it is clear that embodiments, forms of implementation, advantages and the like which are set out below in relation to only one aspect of the invention, in order to avoid repetition, shall of course also apply accordingly in relation to the other aspects of the invention, without any special mention of this being needed.

For all relative and/or percentage weight-based data stated hereinafter, especially relative quantity or weight data, it should further be noted that within the scope of the present invention they are to be selected by the skilled person in such a way that in total, including all components and/or ingredients, especially as defined hereinbelow, they always add up to or total 100% or 100 wt %; this, however, is self-evident to the skilled person.

In any case, the skilled person is able—based on application or consequent on an individual case—to depart, when necessary, from the range data recited hereinbelow, without departing the scope of the present invention.

It is the case, moreover, that all value and/or parameter data stated below, or the like, can in principle be ascertained or determined using standardized or normalized or explicitly specified methods of determination or otherwise by methods of measurement or determination that are familiar per se to the person skilled in this field.

This having been established, the present invention will now be elucidated below in detail.

DETAILED DESCRIPTION OF THE INVENTION

Figure 1:
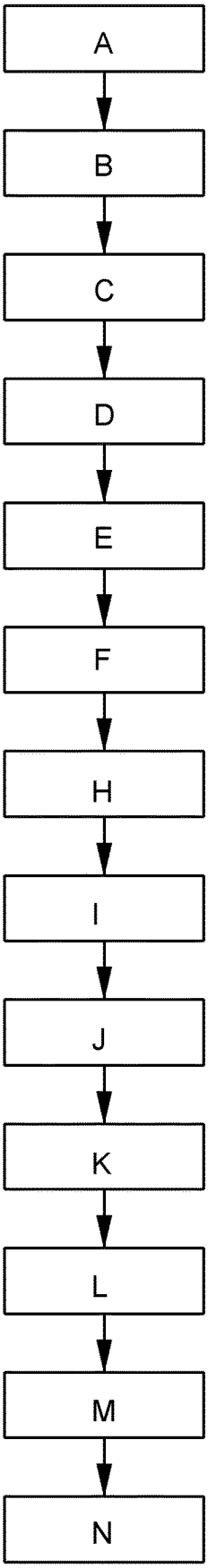
FIG. 1 shows a schematic sequence of the individual stages of the method of the invention.

The invention relates to a system for hot dip galvanizing of components, preferably for the large-scale (high-volume) hot dip galvanizing of a multiplicity of identical or similar components, in particular in discontinuous operation, preferably for batch galvanizing, having a conveying device with at least one goods carrier for the grouped conveying of a plurality of components to be attached on the goods carrier; an optionally decentralized degreasing device for degreasing the components; a surface treating device, in particular pickling device, preferably for chemical, in particularly wet-chemical, and/or mechanical surface treatment of the components, preferably for pickling the surface of the components, a flux application device for applying flux to the surface of the components; and a hot dip galvanizing device for hot dip galvanizing the components, having a galvanizing bath comprising a zinc/aluminum alloy in liquid melt form.

In accordance with the invention, in a system of the aforesaid kind, to solve the problem addressed, a separating (isolating) and singling device is provided for the preferably automated supplying, immersing, and emersing of a component the goods carrier into the galvanizing bath of the hot dip galvanizing device.

In method terms, the invention relates accordingly to a method for hot dip galvanizing components using a zinc/aluminum alloy in liquid melt form, preferably for large-scale hot dip galvanizing a multiplicity of identical or similar components, more particularly in discontinuous operation, preferably for batch galvanizing. Here it is provided that the components prior to hot dip galvanizing are attached on an goods carrier for grouped conveying. After that, the components are subjected to surface treatment, preferably to chemical, more particularly wet-chemical, and/or mechanical surface treatment, more particularly pickling. Subsequently, the components are provided on their surface with an application of flux and then the components provided on their surface with the flux are subject to hot dip galvanizing in a galvanizing bath comprising a zinc/aluminum alloy in liquid melt form.

In accordance with the invention, in the aforesaid method, it is provided that in the hot dip galvanizing, the components are separated and singled out from the goods carrier and/or are supplied in the separated (isolated) and singled out state, preferably with automation, to the galvanizing bath, and are immersed therein and subsequently emersed therefrom.

As a result, the invention differs from the prior art in that the components are separated and singled out from the originally grouped state and in a separated and singled out state are supplied to the galvanizing bath of the zinc/aluminum alloy. This measure, appearing at first glance to be uneconomic and entailing operational delay, has surprisingly proven particularly preferable, particularly with regard to the production of components hot dip galvanized with high precision.

In terms of economic aspects, the solution according to the invention was initially shunned, since in the prior-art batch galvanizing operation, depending on size and weight, components numbering in some cases several hundred are suspended from an goods carrier and galvanized simultaneously and jointly. Separating and singling the components from the goods carrier ahead of galvanizing, and galvanizing them in the separated and singled out state, therefore in the first instance causes a considerable increase in the time duration of the galvanizing operation itself.

In connection with the invention, however, it was recognized that particularly in the case of certain components, such as high-strength and ultra high-strength steels, which are temperature-sensitive, there is a need for targeted and optimized handling of the components during the actual galvanizing operation. With individualized galvanizing in connection with the system of the invention and/or the method of the invention it is readily possible to ensure that the components are each subject individually to identical operating parameters. Particularly for spring steels or chassis and bodywork components made from high-strength and ultra high-strength steels, such as for example press-hardened forming parts this has a considerable part to play. By separating and singling the components for galvanization it is possible for the reaction times between the steel and the zinc melt to be the same in each case. This results ultimately in a zinc layer thickness which is always the same. Furthermore, the galvanization influences the characteristics of the components identically, since the invention ensures that the components have each been subjected to identical operational parameters.

A further, significant advantage of the invention results from the fact that, with the separation (isolation) and singling in accordance with the invention, each component can be manipulated and treated precisely, for example by means of specific rotating and steering movements of the component on extraction from the melt. By this means it is possible to reduce significantly and in some cases avoid completely the cost and effort of afterworking. Furthermore, the invention affords the possibility of reducing significantly accumulations of zinc ash, and in some cases, indeed, of preventing them. This is possible because the process of the invention can be controlled in such a way that a component for galvanizing in the separated (isolated) and singled out state, after immersion, is moved away from the immersion site and moved toward a site remote from the immersion site. Subsequently, emersion is carried out. While the zinc ash rises in the region of the immersion site and is located on the surface of the immersion site, there are few or no residues of zinc ash at the emersion site. By means of this specific technique, it is possible to reduce considerably, or prevent, accumulations of zinc ash.

In connection with the present invention it has been ascertained that, taking account of the reworking being no longer necessary in some cases in the case of the invention, it is in fact possible to reduce the overall production time associated with the manufacture of galvanized components, relative to the prior art, and hence that the invention ultimately provides a higher productivity, and does so not least because the manual afterworking in the prior art is very time-consuming.

A further systemic advantage in the case of separated and singled out galvanization is that the galvanizing tank required need not be broad and deep, but instead only narrow. This reduces the surface area of the galvanizing bath, and in this way that surface can be shielded more effectively, hence allowing a reduction critically in the radiant losses.

As a result, through the invention with the separated galvanization, components are produced that are of greater quality and cleanliness on the surface, with the components as such having each been exposed to identical operating conditions and hence possessing the same component characteristics. From the aspect of economics as well, the invention affords economic advantages relative to the prior art, since the production time, taking account of the no longer necessary or in some cases very limited afterworking, can be reduced by up to 20%.

In the case of the invention it is possible, after the initial grouping of the components over the or on the goods carrier, for the separation (isolation) and the singling to be performed after the surface treatment or after the application of flux. In terms of apparatus, the separation and singling of the components from the goods carrier via the separating and singling device is provided subsequent to the degreasing or subsequent to the surface treating, more particularly pickling, or subsequent to the application of flux. In trials conducted from the standpoint of costs versus benefits, it was ascertained that the most useful is for the components to be separated and singled out from the goods carrier after the application of flux, and hence for the separating and singling device to be located between the hot dip galvanizing device and the flux application device. With this embodiment of the invention, the degreasing, the surface treatment, and the application of flux take place in the grouped condition of the components, with only the galvanizing being performed in the separated and singled out condition.

Device-corresponding, in one preferred embodiment of the invention, it is provided that the separating and singling device comprises at least one separating (isolating) and singling means disposed between the flux application device and the hot dip galvanizing device. This separating and singling means is then preferably configured so that it takes one of the components from the group of the components and supplies it subsequently to the hot dip galvanizing device for hot dip galvanizing. The separating and singling means here may take or remove the component directly from the goods carrier or else take the component from the group of components already deposited from the goods carrier. Here it is understood that in principle it is also possible for more than separating and singling means to be provided, in other words for a plurality of separated and singled out components to be hot dip galvanized in the separated and singled out condition simultaneously. In this connection, it is then also understood that at least the galvanizing operation on the separated and singled out components is carried out identically, even if components from different separating and singling means are guided through the hot dip galvanizing device and/or the galvanizing bath simultaneously or with a temporal offset and independently of one another.

In one alternative form of implementation of the system of the invention and of the associated method, provision is made for the separating and singling means to indeed be configured such that it takes one of the components from the group of the components, but does not supply the taken component directly to the galvanization. The separating and singling means may, for example, transfer the component taken from the group of components to a conveying system belonging to the separating and singling device, such as for example to a goods carrier or a monorail track via which the separated and singled out component is then galvanized in the separated and singled out condition. With this form of implementation, ultimately, provision is made in terms of the system for the separating and singling device to comprise at least two separating and singling means, specifically a first separating and singling means that performs the separation and singling of the components from the group of components, and at least one second separating and singling means, in the manner, for example, of a conveying system, which then guides the separated and singled out component through the galvanizing bath.

In the case of a further, preferred embodiment of the invention, the separating and singling means is configured such that a separated and singled out component is immersed into an immersion region of the bath, then moved from the immersion region to an adjacent emersion region, and subsequently emersed in the emersion region. As already observed above, zinc ash is formed on the surface of the immersion region, as a reaction product of the flux with the zinc melt. By moving the component immersed into the zinc melt from the immersion region toward the emersion region, there is hardly any zinc ash, or none, on the surface of the emersion region. In this way, the surface of the emersed galvanized component remains free or at least substantially free of zinc ash accumulations. Here it is understood that the immersion region is adjacent to the emersion region, and therefore that they are galvanizing bath regions located at a distance from one another, and in particular not overlapping.

In one preferred embodiment of the aforesaid concept of the invention, moreover, provision is made for the component, after immersion, to remain in the immersion region of the galvanizing bath at least until the end of the reaction time between the component surface and the zinc/aluminum alloy of the galvanizing bath. This ensures that the zinc ash, which moves upward within the melt, spreads out only at the surface of the immersion region. Subsequently, the component can then be moved into the emersion region which is substantially free of zinc ash, and can be emersed there.

In trials conducted in connection with the invention, it was found useful if the component spends between 20% to 80%, preferably at least 50%, of the galvanizing time in the region of the immersion region and only then is moved into the emersion region. In system terms this means that the separating and singling device or the associated separating and singling means is or are so designed and, where necessary, harmonized with one another, by appropriate control, that it is possible for the aforementioned method sequence to be carried out without problems.

In particular, in the case of components made of temperature-sensitive steels and in the case of customer-specific requirements for components having near-identical product properties, provision is made, in terms of system and method, for the separating and singling means to be configured such that all of the components separated and singled out from the goods carrier are guided through the galvanizing bath in an identical way, more particularly with identical movement, in identical arrangement and/or with identical time. Ultimately this can be realized readily by means of appropriate control of the separating and singling device or of the at least one assigned separating and singling means. As a result of the identical handling, identical components, in other words components which consist of the same material and have the same shape in each case, have identical product properties in each case. These properties include not only identical zinc layer thicknesses but also the same characteristics for the galvanized components, these components having each been guided identically through the galvanizing bath.

Furthermore, in terms of system and method, the separation and singling allows the invention to offer the advantage that zinc bumps can be avoided more easily. For this purpose, in terms of the system, there is a stripping device subsequent to the emersion region, and, in one preferred embodiment of this concept of the invention, the separating and singling means is configured such that all of the components separated and singled out from the goods carrier, after emersion, are conveyed past the stripping device for stripping off liquid zinc in an identical way. In the case of an alternative embodiment, which, however, can also be realized in combination with the stripping device, all of the components separated and singled out from the goods carrier are moved in an identical way, after emersion, such that drip edges and streaks of liquid zinc are removed, more particularly drip off and/or are spread uniformly over the surfaces of the components. As a result of the invention, therefore, it is ultimately possible for each individual component to be guided in a defined manner not only through the galvanizing bath but also, alternatively, in a defined positioning, as for example an inclined attitude on the part of the component, and to be moved past one or more strippers, and/or for the component to be moved by specific rotating and/or steering movements, after emersion, in such a way that zinc bumps are at least substantially avoided.

Moreover, the system of the invention preferably comprises a plurality of rinsing devices, optionally with two or more rinsing stages. Hence preferably a rinsing device is provided subsequent to the degreasing device and/or subsequent to the surface treatment device. The individual rinsing devices ultimately ensure that the degreasing agents used in the degreasing devices and/or the surface treatment agents used in the surface treatment device are not entrained into the next method stage.

Furthermore, the system of the invention preferably comprises a drying device subsequent to the flux application device, so that the flux is dried following application to the surface of the components. This prevents the entrainment of liquid from the flux solution into the galvanizing bath.

In the case of one preferred development of the invention, subsequent to the hot dip galvanizing device, there is a cooling device, more particularly a quenching device, at which the component, after hot dip galvanization, is cooled and/or quenched.

Furthermore, in particular subsequent to the cooling device, there may be an aftertreatment device. The aftertreatment device is used in particular for passivation, sealing or coloring of the galvanized components. The aftertreatment stage may also for example, however, encompass the afterworking, more particularly the removal of contaminants and/or the removal of zinc bumps. As observed above, however, the afterworking step in the case of the invention is considerably reduced relative to the method known in the prior art, and in some cases is in fact superfluous.

Furthermore, the invention relates to a system and/or a method of the aforesaid kind, wherein the components are iron-based and/or iron-containing components, more particularly steel-based and/or steel-based components, referred to as steel components, preferably automotive components or components for the automobile sector. Alternatively or additionally, the galvanizing bath containing zinc and aluminum in a zinc/aluminum weight ratio in the range of 55-99.999:0.001-45, preferably 55-99.97:0.03-45, more particularly 60-98:2-40, more preferably 70-96:4-30. Alternatively or additionally, the galvanizing bath has the composition below, wherein the weight specifications are based on the galvanizing bath and all of the constituents of the composition in total result in 100 wt %:

(i) zinc, more particularly in amounts in the range from 55 to 99.999 wt %, preferably 60 to 98 wt %;
(ii) aluminum, more particularly in amounts upward of 0.001 wt %, preferably of 0.005 wt %, more preferably in the range from 0.03 to 45 wt %, more preferably in the range from 0.1 to 45 wt %,
(iii) optionally silicon, more particularly in amounts in the range from 0.0001 to 5 wt %, preferably 0.001 to 2 wt %;
(iv) optionally at least one further ingredient and/or optionally at least one impurity, more particularly from the group of the alkali metals such as sodium and/or potassium, alkaline earth metals such as calcium and/or magnesium and/or heavy metals such as cadmium, lead, antimony, bismuth, more particularly in total amounts in the range from 0.0001 to 10 wt %, preferably 0.001 to 5 wt %.

In connection with trials conducted it was found that in the case of zinc baths having the composition indicated above, it is possible to achieve very thin and very homogeneous coatings on the component, these coatings satisfying in particular the exacting requirements with regard to component quality in automotive engineering.

Alternatively or additionally, the flux has the following composition, where the weight specifications are based on the flux and all of the constituents of the composition result in total in 100 wt %:

(i) zinc chloride ($ZnCl_2$), more particularly in amounts in the range from 50 to 95 wt %, preferably 58 to 80 wt %;

(ii) ammonium chloride ($NH_4Cl$), more particularly in amounts in the range from 5 to 50 wt %, preferably 7 to 42 wt %;

(iii) optionally at least one alkali metal salt and/or alkaline earth metal salt, preferably sodium chloride and/or potassium chloride, more particularly in total amounts in the range from 1 to 30 wt %, preferably 2 to 20 wt %;

(iv) optionally at least one metal chloride, preferably heavy metal chloride, more preferably selected from the group of nickel chloride ($NiCl_2$), manganese chloride ($MnCl_2$), lead chloride ($PbCl_2$), cobalt chloride ($CoCl_2$), tin chloride ($SnCl_2$), antimony chloride ($SbCl_3$) and/or bismuth chloride ($BiCl_3$), more particularly in total amounts in the range from 0.0001 to 20 wt %, preferably 0.001 to 10 wt %;

(v) optionally at least one further additive, preferably wetting agent and/or surfactant, more particularly in amounts in the range from 0.001 to 10 wt %, preferably 0.01 to 5 wt %.

Alternatively or additionally, the flux application device, more particularly the flux bath of the flux application device, contains the flux in preferably aqueous solution, more particularly in amounts and/or in concentrations of the flux in the range from 200 to 700 g/l, more particularly 350 to 550 g/l, preferably 500 to 550 g/l, and/or the flux is used as a preferably aqueous solution, more particularly with amounts and/or concentrations of the flux in the range from 200 to 700 g/l, more particularly 350 to 550 g/l, preferably 500 to 550 g/l.

In trials with a flux in the aforesaid composition and/or concentration especially in conjunction with the above-described zinc/aluminum alloy, it was found that very low layer thicknesses, in particular of less than 20 μm, are obtained, this being associated with a low weight and reduced costs. Especially in the automotive sector, these are essential criteria.

Further features, advantages, and possible applications of the present invention are apparent from the description hereinafter of exemplary embodiments on the basis of the drawing, and from the drawing itself. Here, all features described and/or depicted, on their own or in any desired combination, constitute the subject matter of the present invention, irrespective of their subsumption in the claims or their dependency reference.

In the drawing

Figure 2:
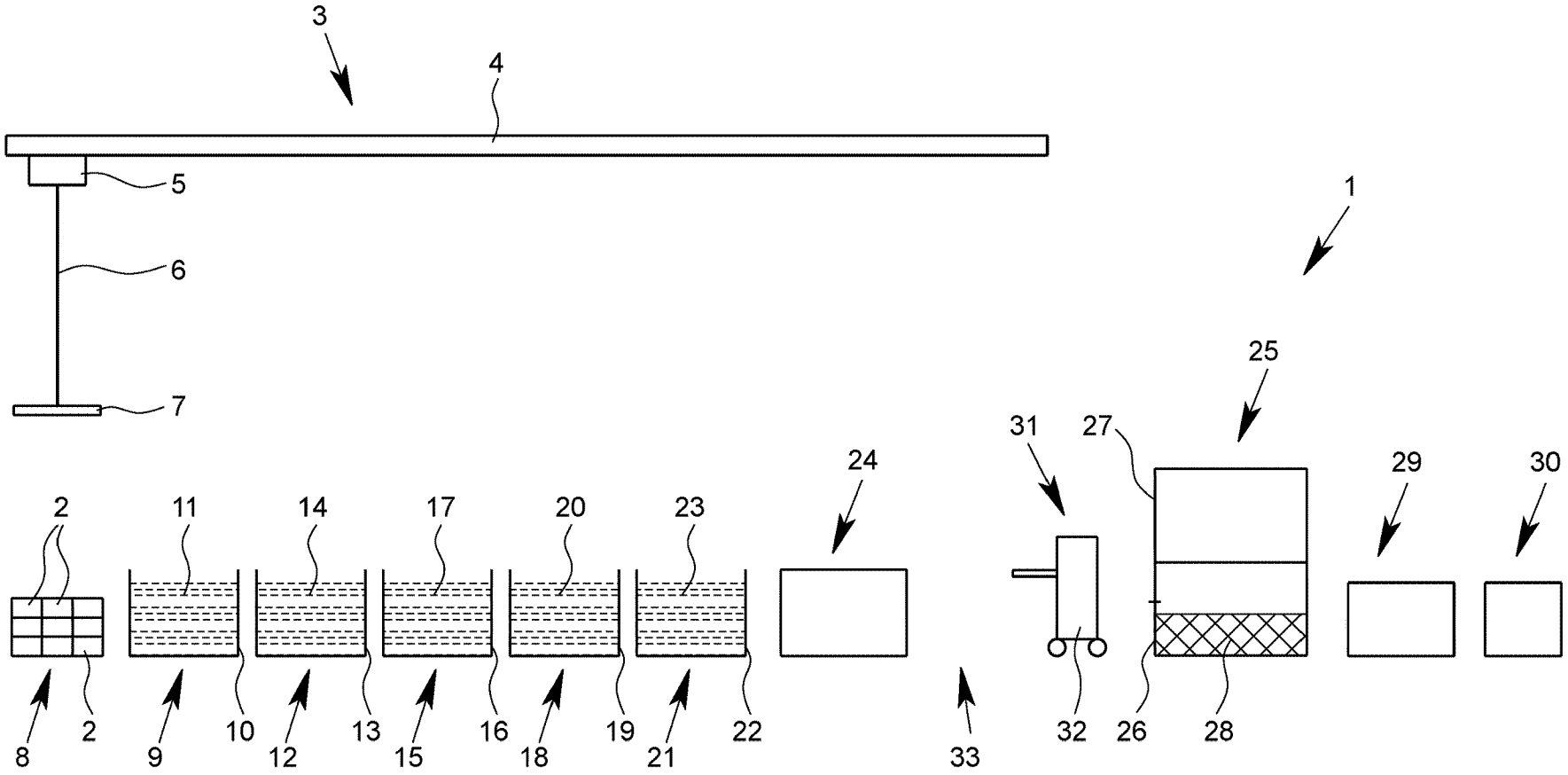
FIG. 2 shows a schematic representation of a system of the invention and of the sequence of the method of the invention in one method step.
Figure 3:
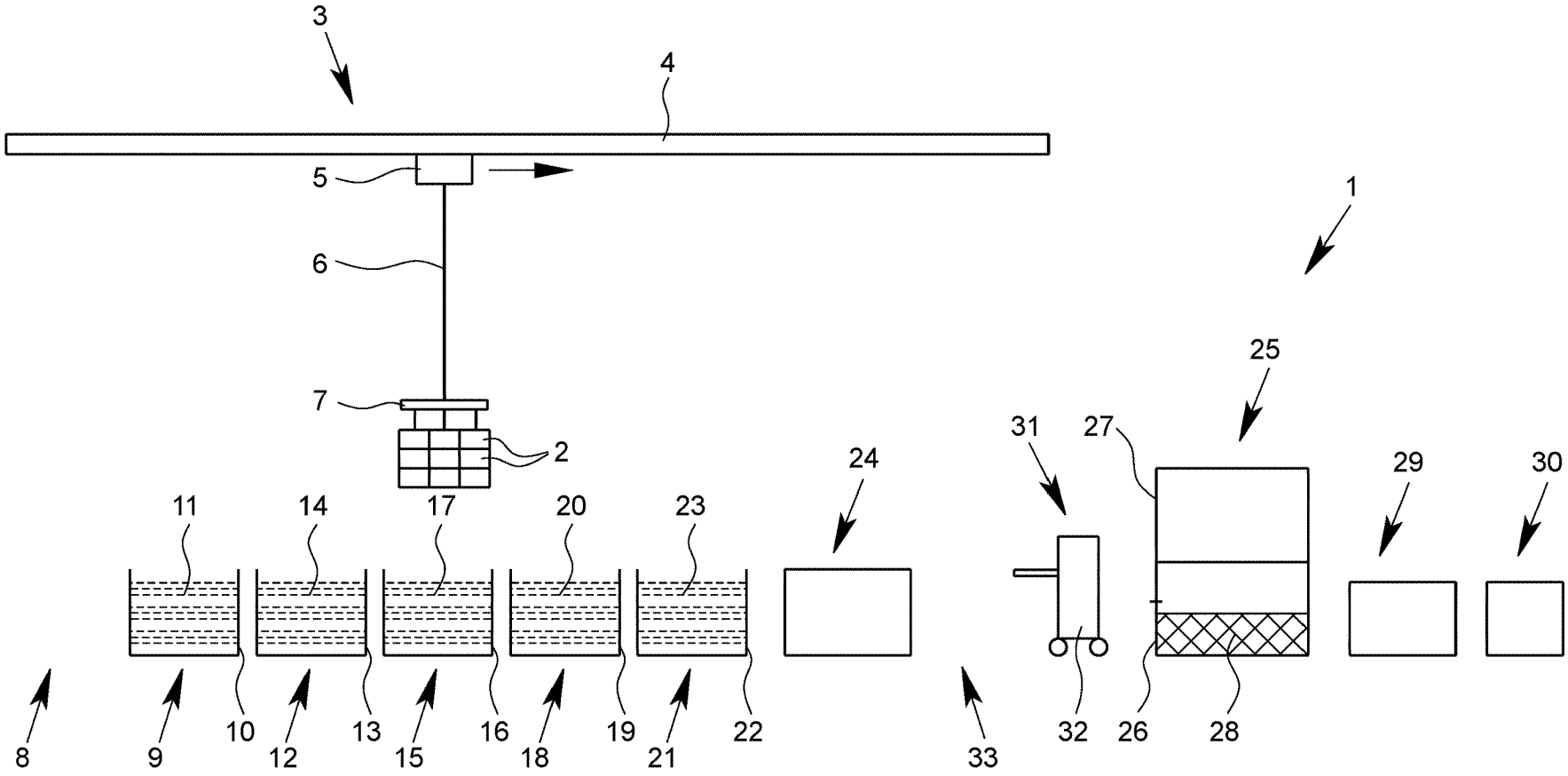
FIG. 3 shows a schematic representation of a system of the invention and of the sequence of the method of the invention in a further method step.
Figure 4:
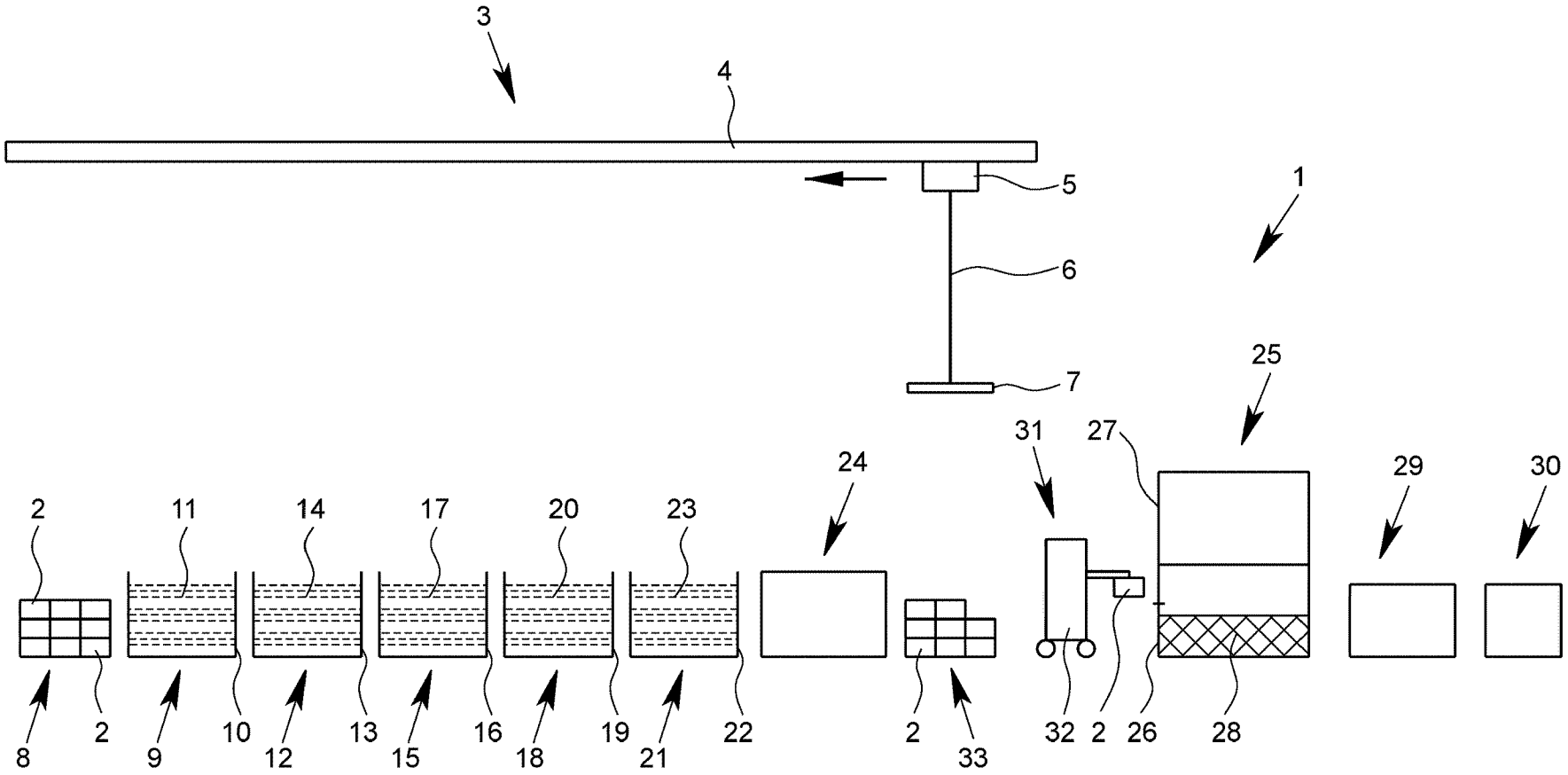
FIG. 4 shows a schematic representation of a system of the invention and of the sequence of the method of the invention in a further method step.

FIG. 1 shows a schematic sequence of the individual stages of the method of the invention, FIG. 2 shows a schematic representation of a system of the invention and of the sequence of the method of the invention in one method step, FIG. 3 shows a schematic representation of a system of the invention and of the sequence of the method of the invention in a further method step, and FIG. 4 shows a schematic representation of a system of the invention and of the sequence of the method of the invention in a further method step.

In FIG. 1 there is a schematic representation of a sequence of the method of the invention in a system 1 of the invention. In this connection it should be pointed out that the sequence scheme shown is one method possible according to the invention, but individual method steps may also be omitted or provided in a different order from that represented and subsequently described. Further method steps may be provided as well. In any case, not all of the method stages need in principle be provided in one centralized system 1. The decentralized realization of individual method stages is also possible.

In the sequence scheme represented in FIG. 1, stage A identifies the supplying and the deposition of components 2 for galvanization at a connection point. In the present example, the components 2 have already been mechanically surface-treated, more particularly sandblasted. This is a possibility but not a necessity.

In stage B, the components 2 are joined with a goods carrier 7 of a conveying device 3 to form a group of components 2. In some cases, the components 2 are also joined to one another and hence joined only indirectly to the goods carrier 7. It is also possible for the goods carrier 7 to comprise a basket, a rack or the like into which the components 2 are placed.

In stage C, the components 2 are degreased. This is done using alkaline or acidic degreasing agents 11, in order to eliminate residues of greases and oils on the components 2.

In stage D, the degreased components 2 are rinsed, in particular with water. This washes off the residues of degreasing agent 11 from the components 2.

In the process step [sic] E, the surfaces of the components 2 undergo pickling, i.e. wet-chemical surface treatment. Pickling takes place customarily in dilute hydrochloric acid.

Stage E is followed by stage F, which is again a rinsing stage, in particular with water, in order to prevent the pickling agent being carried into the downstream process stages.

Then, still assembled as a group on the goods carrier 4, the correspondingly cleaned and pickled components 2 for galvanizing are fluxed, i.e. subjected to a flux treatment. The flux treatment in stage H takes place presently likewise in an aqueous flux solution. After a sufficient residence time in the flux 23, the goods carrier 7 with the components 2 is passed on for drying in stage I in order to generate a solid flux film on the surface of the components 2 and to remove adhering water.

In process step J, the components 2 hitherto assembled as a group are separated and singled out, in other words taken from the group, and subsequently further treated in the separated and singled out condition. This separation and singling may be accomplished by taking off the components 2 individually from the goods carrier 7 or else by the goods carrier 7 first depositing the group of components 2 and the components 2 then being removed individually from the group.

Following the separation in step J, the components 2 are then hot dip galvanized in the stage K. For this purpose, the components 2 are immersed each individually into a galvanizing bath 28 and, after a specified residence time, are emersed again.

The galvanizing in process step K is followed by dropping of the still liquid zinc in stage L. The dropping is accomplished by moving the component 2, galvanized in the separated and singled out condition, along one or more strippers of a stripping device, or by specified pivoting and rotating movements of the component 2, leading either to the dripping or else to the uniform spreading of the zinc on the component surface.

The galvanized component is subsequently quenched in step M.

The quenching in process step M is followed by an aftertreatment in stage N, this aftertreatment possibly, for example, being a passivation, sealing, or organic or inorganic coating of the galvanized component 2. The aftertreatment, however, also includes any afterwork possibly to be performed on the component 2.

In FIGS. 2 to 4, an exemplary embodiment of a system 1 of the invention is represented schematically.

In FIGS. 2 to 4, in a schematic representation, one embodiment is depicted of a system 1 of the invention for the hot dip galvanizing of components 2. The system 1 is intended for hot dip galvanizing a multiplicity of identical components 2 in discontinuous operation, referred to as batch galvanizing. In particular, the system 1 is designed and suitable for the hot dip galvanizing of components 2 in large-scale production. Large-scale galvanizing refers to galvanizing wherein more than 100, more particularly more than 1000, and preferably more than 10 000 identical components 2 are galvanized in succession without interim galvanizing of components 2 of different shape and size.

The system 1 comprises a conveying device 3 for conveying or for simultaneously transporting a plurality of components 2 which are assembled in a group. The conveying device 3 presently comprises a crane track with a rail guide 4, on which a trolley 5 with lift mechanism can be driven. A goods carrier 7 is connected to the trolley 5 via a lifting cable 6. The purpose of the goods carrier 7 is to hold and fasten the components 2. The components 2 are customarily joined to the goods carrier 7 at a connection point 8 in the system, at which the components 2 are grouped for joining to the article carrier 7.

The connection point 8 is followed by a degreasing device 9. The degreasing device 9 comprises a degreasing tank 10 which accommodates a degreasing agent 11. The degreasing agent 11 may be acidic or basic. The degreasing device 9 is followed by a rinsing device 12, comprising rinsing tank 13 with rinsing agent 14 located therein. The rinsing agent 14, presently is water. After the rinsing device 12, in other words downstream thereof in the process direction, is a surface treatment device configured as a pickling device 15 for the wet-chemical surface treatment of the components 2. The pickling device 15 comprises a pickling tank 16 with a pickling agent 17 located therein. The pickling agent 17, presently, is dilute hydrochloric acid.

Subsequent to the pickling device 15 there is, again, a rinsing device, 18, with rinsing tank 19 and rinsing agent 20 located therein. The rinsing agent 20 is again water.

Downstream of the rinsing device 18 in the process direction is a flux application device 21 comprising a flux tank 22 and flux 23 located therein. In a preferred embodiment, the flux contains zinc chloride ($ZnCl_2$) in an amount of 58 to 80 wt % and also ammonium chloride ($NH_4Cl$) in the amount of 7 to 42 wt %. Furthermore, in a small amount, there may optionally be alkali metal salts and/or alkaline earth metal salts and also, optionally, accordingly in a further reduced amount, a heavy metal chloride. Additionally there may optionally be a wetting agent in small amounts. It is understood that the aforesaid weight figures are based on the flux 23 and make up 100 wt % in the sum total of all constituents of the composition. Moreover, the flux 23 is present in aqueous solution, specifically at a concentration in the range from 500 to 550 g/l.

It should be noted that the aforesaid devices 9, 12, 15, 18, and 21 may in principle each comprise a plurality of tanks. These individual tanks, and also the tanks described above, are arranged one after another in the manner of cascades.

The flux application device 21 is followed by a drying device 24, for removal of adhering water from the film of flux located on the surface of the components 2.

Furthermore, the system 1 comprises a hot dip galvanizing device 25, in which the components 2 are hot dip galvanized. The hot dip galvanizing device 25 comprises a galvanizing tank 26, optionally with a housing 27 provided at the top. In the galvanizing tank 26 there is a galvanizing bath 28 containing a zinc/aluminum alloy. Specifically, the galvanizing bath contains 60 to 98 wt % of zinc and 2 to 40 wt % of aluminum. Furthermore, optionally, small amounts of silicon and, optionally in further-reduced proportions, a small amount of alkali metals and/or alkaline earth metals and also heavy metals are provided. It is understood here that the aforesaid weight specifications are based on the galvanizing bath 28 and in total make up 100 wt % of all constituents of the composition.

Located after the hot dip galvanizing device 25 in process direction is a cooling device 29 which is provided for quenching the components 2 after the hot dip galvanizing. Finally, after the cooling device 29, an aftertreating device 30 is provided, in which the hot dip galvanized components 2 can be aftertreated and/or afterworked.

Located between the drying device 24 and the hot dip galvanizing device 25 is a separating and singling device 31, which is provided for the automated supplying, immersion, and emersion of a component 2, separated from the goods carrier 7, into the galvanizing bath 28 of the hot dip galvanizing device 25. In the exemplary embodiment shown, the separating and singling device 31 comprises a separating and singling means 32 which is provided for the handling of the components 2, specifically for removing a component 2 from the group of the components 2 and/or for taking the grouped components 2 from the goods carrier 7, and also for the supplying, immersing, and emersing of the separated and singled out component 2 into the galvanizing bath 28.

For the separation and singling, there is a transfer point 33 located between the separating and singling means 32 and the drying device 24, and at this point 33 the components 2 either are put down or else, in particular in the hanging condition, can be separated and singled out and/or taken from the goods carrier 7 and hence from the group. For this purpose, the separating and singling means 32 is preferably configured such that it can be moved in the direction of and away from the transfer point 33 and/or can be moved in the direction of and away from the galvanizing device 25.

Moreover, the separating and singling means 32 is configured such that it moves a component 2, immersed separately and singled out into the galvanizing bath 28, from the immersion region to an adjacent emersion region and subsequently emerses it in the emersion region. The immersion region and the emersion region here are spaced apart from one another, i.e. do not correspond to one another. In particular, the two regions also do not overlap. The movement from the immersion region to the emersion region here takes place only after a specified period of time has expired, namely after the end of the reaction time of the flux 23 with the surface of the respective components 2 for galvanizing.

Furthermore, the separating and singling device 31 centrally and/or the separating and singling means 32 locally possesses a control device, whereby the separating and singling means 32 is moved such that all of the components 2 separated and singled out from the goods carrier 7 are guided through the galvanizing bath 28 with identical movement in identical arrangement, and with identical time.

Not depicted is the presence, above the galvanizing bath 28 and still within the housing 27, of a stripper of a stripping device (not shown), this stripper being intended for the stripping of liquid zinc. Moreover, the separating and singling means 32 may also be controlled, via the assigned control device, in such a way that a component 2 which has already been galvanized is moved, still within the housing 27, for example, by corresponding rotational movements, in such a way that excess zinc drips off and/or, alternatively, is spread uniformly over the component surface.

FIGS. 2 to 4 then represent different conditions during operation of the system 1. FIG. 2 shows a condition wherein a multiplicity of components 2 for galvanizing are deposited at the connection point 8. Above the group of components 2 there is the goods carrier 7. After the goods carrier 7 has been lowered, the components 2 are attached on the goods carrier 7. In the exemplary embodiment depicted, the components 2 are arranged in layers. In this case it is possible for all components 7 to be joined in each case to the goods carrier 7. It is, however, also possible for only the upper layer of components 2 to be joined to the goods carrier 7, while the subsequent layer is joined to the layer lying respectively above it. A further possibility is for the group of components 2 to be disposed in a basket-like rack or the like.

In FIG. 3, the group of components 2 is located above the pickling device 15. Stages C and D, namely the degreasing and rinsing, have already been performed.

In FIG. 4, the group of components 2 has been deposited at the transfer point 33. The trolley 5 is on the way back to the connection point 8, at which new components 2 for galvanizing are already present in the form of a group. One component 2 has already been taken, via the separating and singling means 32, from the group of components 2 deposited at the transfer point 33, and this component 2 is about to be fed into the hot dip galvanizing device 25.

LIST OF REFERENCE SYMBOLS

| | |
|---|---|
| 1 | system |
| 2 | component |
| 3 | conveying device |
| 4 | rail guide |
| 5 | trolley |
| 6 | lifting cable |
| 7 | goods carrier |
| 8 | connection point |
| 9 | degreasing device |
| 10 | degreasing tank |
| 11 | degreasing agent |
| 12 | rinsing device |
| 13 | rinsing tank |
| 14 | rinsing agent |
| 15 | pickling device |
| 16 | pickling tank |
| 17 | pickling agent |
| 18 | rinsing device |
| 19 | rinsing tank |
| 20 | rinsing agent |
| 21 | flux application device |
| 22 | flux tank |
| 23 | flux |
| 24 | drying device |
| 25 | hot dip galvanizing device |
| 26 | galvanizing tank |
| 27 | housing |
| 28 | galvanizing bath |
| 29 | cooling device |
| 30 | aftertreating device |
| 31 | separating and singling device |
| 32 | separating and singling means |
| 33 | transfer point |

The invention claimed is:

1. A hot-dip galvanization system for the large-scale hot-dip galvanization of a plurality of identical or similar components, wherein the system comprises:

a conveying device with at least one goods carrier for the grouped conveying of a plurality of components to be attached on the goods carrier;

a degreasing device for degreasing the components;

a surface-treating device for the chemical, mechanical or chemical and mechanical surface-treatment of the components;

a flux application device for applying a flux to the surface of the components; and a hot-dip galvanizing device for hot-dip galvanizing the components , wherein the hot-dip galvanizing device comprises a galvanizing bath comprising a zinc/aluminum alloy in a liquid molten form;

wherein the system is configured to operate in a discontinuous operation, wherein the system further comprises a separating and singling device configured to provide for the supply, immersion and emersion of a single component separated and singled out from the grouped plurality of components attached on the goods carrier to, into and out of the galvanizing bath of the hot-dip galvanizing device, wherein the separating and singling device comprises at least one separating and singling means disposed between the flux application device and the hot-dip galvanizing device, wherein the separating and singling means is designed or equipped in such a way that during the separation and singling out, each component is precisely manipulated and treated by means of rotating and steering movements specific to the component upon emersion from the galvanizing bath, wherein the separating and singling means is designed or equipped in such a way that all of the components separated and singled out from the grouped plurality of components attached on the goods carrier are moved, after emersion, in an identical way and such that drip edges or drip streaks are removed, and wherein furthermore a stripping device is provided subsequent to the emersion region of the galvanizing bath.

2. The system as claimed in claim 1, wherein the separation and singling of the components from the goods carrier via the separating and singling device is provided subsequent to one of the degreasing, the surface-treating and the flux application.

3. The system as claimed in claim 1, wherein the separating and singling means is designed and equipped such that each component separated and singled out undergoes immersion into an immersion region of the galvanizing bath and is then moved from the immersion region to an adjacent emersion region and is subsequently emersed in the emersion region.

4. The system as claimed in claim 1, wherein the separating and singling means is designed or equipped such that all of the components separated and singled out from the grouped plurality of components attached on the goods carrier are guided through the galvanizing bath in an identical way.

5. The system as claimed in claim 1, wherein furthermore at least one rinsing device is provided.

6. The system as claimed in claim 1, wherein furthermore a drying device is provided subsequent to the flux application device.

7. The system as claimed in claim 1, wherein furthermore a cooling device is provided subsequent to the hot-dip galvanizing device.

8. The system as claimed in claim 1, wherein furthermore an after-treatment device is provided subsequent to the hot-dip galvanizing device.

9. The system as claimed in claim 1, wherein the components are steel-based or steel-containing components.

10. The system as claimed in claim 1, wherein the components are steel-based or steel-containing components for the automotive sector.

11. A hot-dip galvanization system for the large-scale hot-dip galvanization of a plurality of identical or similar components, wherein the system comprises:

a conveying device with at least one goods carrier for the grouped conveying of a plurality of components to be attached on the goods carrier;

a degreasing device for degreasing the components;

a surface-treating device for the chemical, mechanical or chemical and mechanical surface-treatment of the components;

a flux application device for applying a flux to the surface of the components; and a hot-dip galvanizing device for hot-dip galvanizing the components, wherein the hot-dip galvanizing device comprises a galvanizing bath comprising a zinc/aluminum alloy in a liquid molten form;

wherein the system is configured to operate in a discontinuous operation, wherein the system further comprises a separating and singling device configured to provide for the supply, immersion and emersion of a single component separated and singled out from the grouped plurality of components attached on the goods carrier to, into and out of the galvanizing bath of the hot-dip galvanizing device, wherein the separating and singling device comprises at least one separating and singling means disposed between the flux application device and the hot-dip galvanizing device, wherein the separating and singling means is designed or equipped in such a way that during the separation and singling out, each component is precisely manipulated and treated by means of rotating and steering movements specific to the component upon emersion from the galvanizing bath, wherein the separating and singling means is designed or equipped in such a way that all of the components separated and singled out from the grouped plurality of components attached on the goods carrier are moved, after emersion, in an identical way and such that drip edges or drip streaks are removed, and wherein furthermore a stripping device is provided subsequent to the emersion region of the galvanizing bath.

12. A hot-dip galvanization system for the large-scale hot-dip galvanization of a plurality of identical or similar components, wherein the system comprises:

a conveying device with at least one goods carrier for the grouped conveying of a plurality of components to be attached on the goods carrier;

a degreasing device for degreasing the components;

a surface-treating device for the chemical, mechanical or chemical and mechanical surface-treatment of the components;

a flux application device for applying a flux to the surface of the components; and a hot-dip galvanizing device for hot-dip galvanizing the components, wherein the hot-dip galvanizing device comprises a galvanizing bath comprising a zinc/aluminum alloy in a liquid molten form;

wherein the system is configured to operate in a discontinuous operation, wherein the system further comprises a separating and singling device configured to provide for the supply, immersion and emersion of a single component separated and singled out from the grouped plurality of components attached on the goods carrier to, into and out of the galvanizing bath of the hot-dip galvanizing device, wherein the separating and singling device comprises at least one separating and singling means disposed between the flux application device and the hot-dip galvanizing device, wherein the separating and singling means is designed or equipped in such a way that during the separation and singling out, each component is precisely manipulated and treated by means of rotating and steering movements specific to the component upon emersion from the galvanizing bath, and wherein the separating and singling means is designed or equipped in such a way that all of the components separated and singled out from the grouped plurality of components attached on the goods carrier are moved, after emersion, in an identical way and such that drip edges or drip streaks are removed.

* * * * *